US005588755A

United States Patent [19]

Nimura

[11] Patent Number: 5,588,755

[45] Date of Patent: Dec. 31, 1996

[54] UNWINDING APPARATUS FOR UNWINDING TAPE-LIKE SHEET MEMBER

[75] Inventor: Wataru Nimura, Ome, Japan

[73] Assignee: Casio Computer Co., Ltd., Tokyo, Japan

[21] Appl. No.: 425,421

[22] Filed: Apr. 21, 1995

[30] Foreign Application Priority Data

Apr. 30, 1994 [JP] Japan ..... 6-113606

[51] Int. Cl.[6] ..... B41J 33/14

[52] U.S. Cl. ..... 400/234; 400/120.17; 400/248.2

[58] Field of Search ..... 400/120.16, 120.17, 400/223, 224.2, 234, 236, 247, 248.2, 246, 691, 692

[56] References Cited

U.S. PATENT DOCUMENTS 4,702,631 10/1987 Watanabe ..... 400/224.2
4,944,619 7/1990 Suzuki et al. ..... 400/224.2
5,153,606 10/1992 Bas ..... 400/120.16
5,370,470 12/1994 Kim ..... 400/234
5,478,159 12/1995 Schneider et al. ..... 400/234

*Primary Examiner*—John S. Hilten
*Attorney, Agent, or Firm*—Frishauf, Holtz, Goodman, Langer & Chick

[57] ABSTRACT

In the present invention, an unwinding shaft in a cassette is rotated to unwind a sheet member by an unwinding mechanism in connection with a movement of a head attaching member when the head attaching member is such a direction as to separate the head member from the sheet member in the cassette. Also, the sheet member is applied with a back tension in a direction opposite to the winding tension by a back tension applying mechanism when the winding shaft winds the sheet member by a winding device of a winding motor.

15 Claims, 5 Drawing Sheets

UNWINDING APPARATUS FOR UNWINDING TAPE-LIKE SHEET MEMBER

BACKGROUND OF THE INVENTION

1. Field of the Invention

The present invention relates to an unwinding apparatus for unwinding a tape-like sheet.

2. Description of Related Art

There is used a ribbon cassette receiving an ink ribbon in a winding state for a printer for printing on a recording paper by a heat transfer and the like. Also, there is used a tape cassette receiving a magnetic tape in a winding state for an audio equipment, and further, there is used a tape cassette receiving a video tape in a winding state for a video apparatus. These ribbon cassette and tape cassette are loaded into respective equipments, thereby a printing, a recording and a playback of a voice and an image and the like are carried out.

By the way, in a conventional printer of a type in which a printing is performed on the recording paper, among these apparatuses, a ribbon cassette provided therein with a tape-like ink ribbon is inserted into an apparatus main body through a cassette inlet and outlet opening formed on a side portion of the apparatus main body, and the inserted ribbon cassette is set at a predetermined position of the apparatus main body. After that, when a head attaching member disposed movably in upward and downward directions to the apparatus main body is pressed down, the printing head disposed on the printing attaching member is inserted into the ribbon cassette through an upper opening member formed on the ribbon cassette. Then, since a platen is arranged at a position opposed to the printing head, the printing head is abutted to the platen through the ink ribbon and the recording paper. Under such a circumstance, a winding motor is driven to rotate a winding shaft for winding a ribbon disposed in the cassette. A printing signal is supplied to the printing head while winding the ink ribbon by the rotation of the winding shaft, then an ink formed on the ink ribbon is transferred to the recording paper to perform a printing by heat-generating and driving an exothermic element disposed on the printing head.

In case of the conventional printer having such a construction, as described above, the head attaching member is rotated downward after the ribbon cassette is loaded, then the printing head disposed on the head attaching member is entered into the ribbon cassette through the upper opening portion formed on an upper portion of the cassette, and further the printing head is press-contacted to the platen through the ink ribbon and the recording paper. However, since the platen is arranged below a position of the lower opening portion formed on a lower portion of the cassette, the printing head entering into the ribbon cassette is pressed down to below the position of the lower opening portion of the cassette. Accordingly, a portion of the ink ribbon to which the printing head abuts is protruded outwardly from the lower opening portion of the ribbon cassette.

On the other hand, in order to take out the ribbon cassette from the apparatus main body, the head attaching main body is moved upwardly to cause the printing head to retreat from an inside of the ribbon cassette, and then, the ribbon cassette is taken out outward from the cassette inlet and outlet opening formed on the side portion of the apparatus main body. At that occasion, as described above, since one portion of the ink ribbon is maintained to be protruded outward partially from the lower opening portion of the ribbon cassette, the protruding portion of the ink ribbon is caught by a lower edge of the cassette inlet and outlet opening, and a chassis or electronic parts and the like in the apparatus main body, there is a case that the ribbon cassette cannot be taken out therefrom. In order to prevent such a matter, conventionally, the unwinding shaft for unwinding the ink ribbon and the unwinding motor are connected to each other, and the motor is driven in connection with the upward movement of the head attaching member to rotate the unwinding shaft in the unwinding direction for the ink ribbon. Thereby, the ink ribbon is unwound to eliminate a protruding portion, that is, a dip portion of the ink ribbon. Then, the ribbon cassette is caught by the lower edge of the cassette inlet and outlet opening, or the chassis or the electronic and the like in the apparatus main body, so that the ink ribbon is taken out smoothly and rapidly.

However, in such conventional printer, since the tape-like ink ribbon is unwound by the driving of the motor disposed in the apparatus main body, the unwinding of the ink ribbon cannot be performed in a case where the motor is out of order, the driving circuit of the motor is disconnected, or the electric power for driving the whole apparatus is off. Accordingly, the protruding portion, that is, a dip portion of the ink ribbon cannot be eliminated, there is a problem that the ink ribbon cannot be taken out from the apparatus main body smoothly and rapidly.

SUMMARY OF THE INVENTION

The present invention is directed to eliminating these conventional drawbacks.

It is, therefore, an object of the present invention to provide an unwinding apparatus for unwinding a tape-like sheet member rapidly and easily without a driving of a motor.

Further, it is another object of the present invention to provide an unwinding apparatus in which a tape-like sheet like member runs stably.

In order to attain such objects, the present invention provides an unwinding apparatus comprising: an apparatus main body having a cassette inlet and outlet opening at a side portion thereof; a cassette detachable to the apparatus main body through the cassette inlet and outlet opening of the apparatus main body, provided therein with a winding shaft, an unwinding shaft and a tape-like sheet member bridged between the winding shaft and the unwinding shaft, and formed with upper and lower opening portions at upper and lower portions thereof; a head member inserted into the cassette through the upper opening portion formed on the cassette for pressing down the sheet member to below a position of the lower opening portion; a head attaching member attached with the head member and disposed on the apparatus main body movably in an upward and downward direction so as to bring the head member into contact with the sheet member and separate the head member from the sheet member; an abutting member disposed on the apparatus main body at a position opposed to the head member so as to abut to the head member through the sheet member; and an unwinding means for rotating the unwinding shaft to unwind the sheet member in connection with the movement of the head attaching member when the head attaching member moves in such a direction as to separate the head member from the sheet member.

According to the present invention having such the construction, when the head attaching member is moved in such a direction as to separate the head member from the sheet member in the cassette, the unwinding shaft in the cassette is rotated by the unwinding means in connection with the movement of the head attaching member, so that the sheet member can be unwound automatically. That is, the sheet member can be unwound mechanically in connection with an movement in which the head member separate from the cassette. As a result, the sheet member can be unwound rapidly and easily without using the unwinding motor.

DESCRIPTION OF THE PREFERRED EMBODIMENT

FIGS. 1 to 8 show one embodiment in which the present invention is applied to a heat transfer printer.

Figure 1:
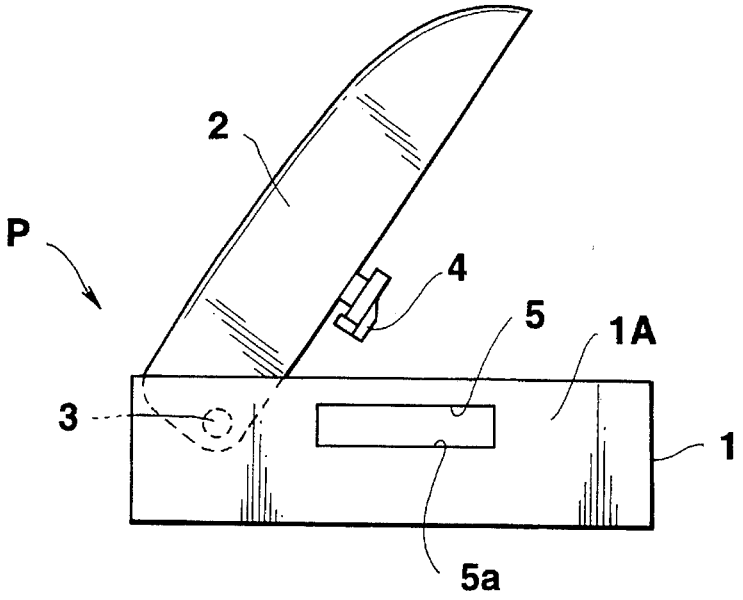
FIG. 1 is a side view of an embodiment in which the apparatus of the present invention is applied to a printer.

FIG. 1 shows a whole construction of this printer.

As shown in FIG. 1, the printer P comprises an apparatus main body 1, and a cover member 2 rotating with a supporting shaft 3 as a center for performing an opening and closing movement. A side plate 1A of the apparatus main body 1 is provided with an inlet and outlet opening 5 through which a ribbon cassette 30 described later is entered into and taken out from the apparatus main body 1. This inlet and outlet opening 5 has an opening size which is rather larger than an external shape size of the ribbon cassette 30 (Refer to FIG. 3). The ribbon cassette 30 is inserted horizontally toward the inlet and outlet opening 5 from an outside of the apparatus main body 1, and set at an inside of the apparatus main body 1 at a predetermined position through the inlet and outlet opening 5. The ribbon cassette 30 set inside the apparatus main body 1 at the predetermined position is taken out through the inlet and outlet opening 5 from the inside of the apparatus main body 1 to the outside of the apparatus main body 1.

Figure 2:
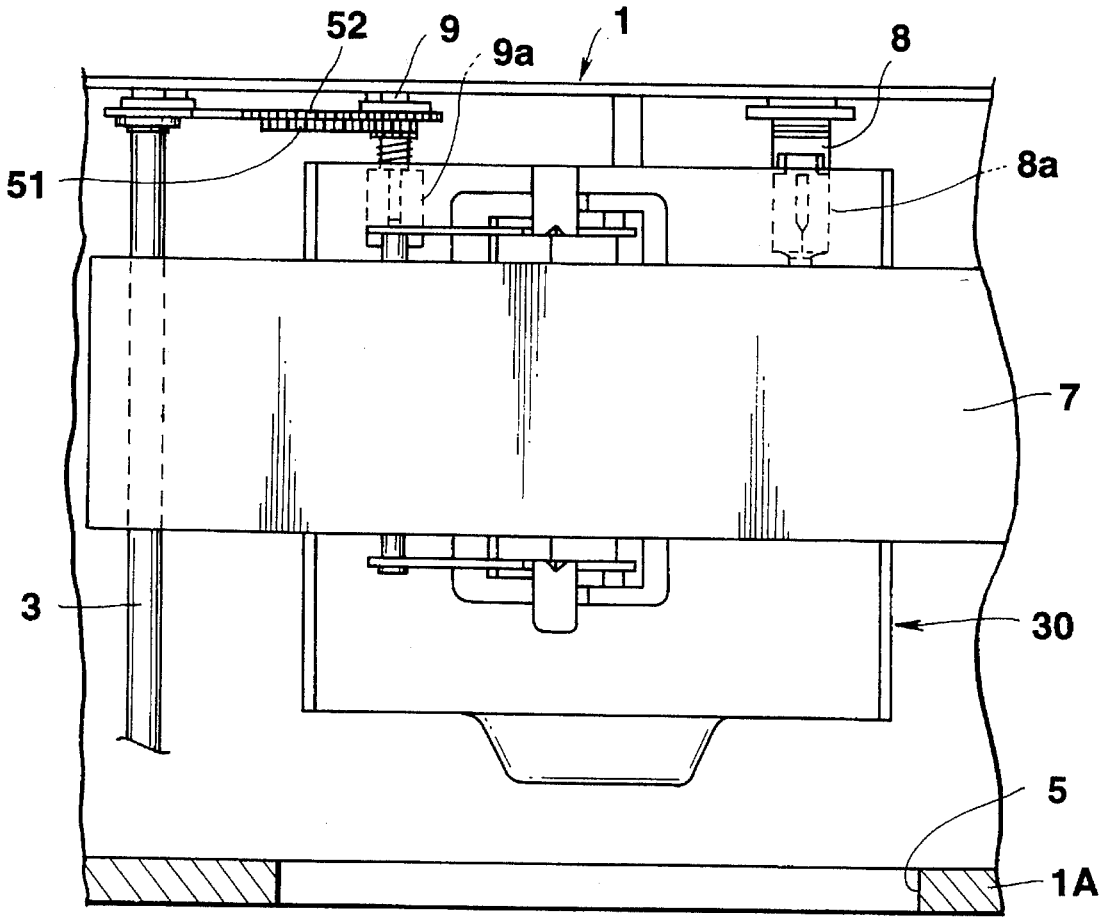
FIG. 2 is a plan view of a main part around a winding shaft and an unwinding shaft.
Figure 3:
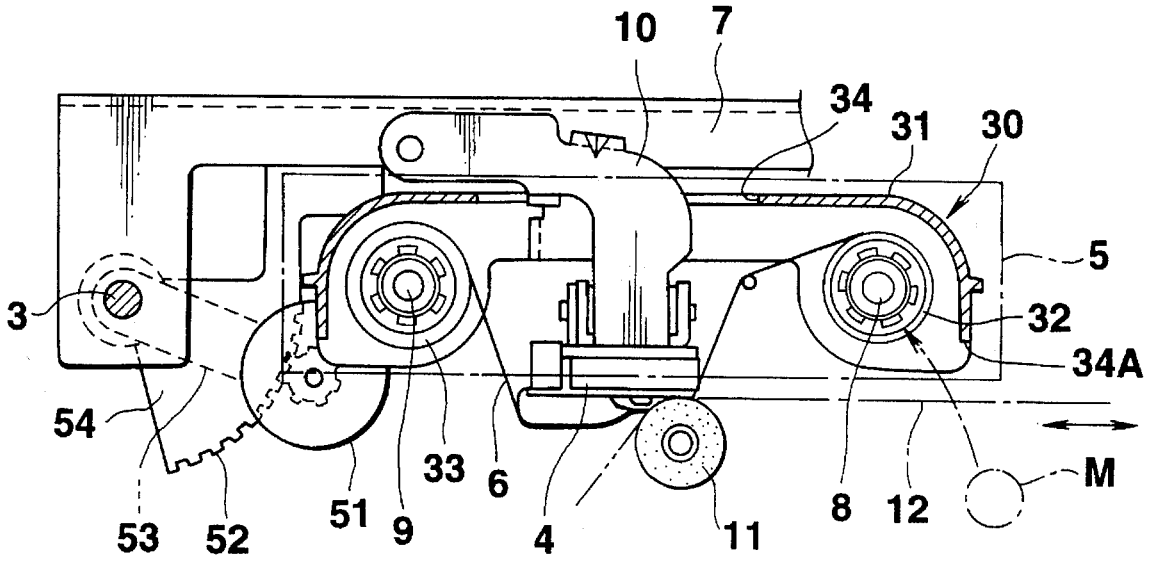
FIG. 3 is a side view of a main part around a winding shaft and an unwinding shaft.

FIGS. 2 and 3 show a state in which the ribbon cassette 30 is inserted from the inlet and outlet opening 5 and set inside the apparatus main body 1.

As shown in FIG. 2, a winding shaft 8 for winding an ink ribbon and an unwinding shaft 9 are disposed on a side plate 1A so as to protrude toward the ribbon cassette 30 set in the apparatus main body 1. Respective leading ends of the winding shaft 8 and the unwinding shaft 9 are attached with cups 8*a*, 9*a* entering into the ribbon cassette 30.

The winding shaft 8 is coupled to a motor M disposed in the apparatus main body 1, and is adapted to rotate in such a direction as to wind the ink ribbon 6 due to driving of the motor M.

On a lower face of the cover member 2 is disposed a head attaching member 7 constituting one part of the cover member 2. The head attaching member 7 is inserted through with the supporting shaft 3 of the cover member 2. When the supporting shaft 3 is rotated integrally with the rotating opening and closing movement of the cover member 2, the head attaching member 7 also is adapted to rotate the supporting shaft 3 in the same direction with the supporting shaft 3 as a rotation center.

Such head attaching member 7 is, as shown in FIG. 3, attached with a curved head arm 10. A leading end of the head arm 10 is attached with a printing head 4. A platen 11 is arranged at an opposite position of the printing head 4.

The printing head 4 is adapted to press-contact to the platen 11 through the ink ribbon 6 and a recording paper 12, and, under the press-controlling state, to generate heat according to a printing signal transmitted from a printing control portion (not shown), and to ensure a printing by melting an ink formed on the ink ribbon to transfer the ink on the recording paper 12.

The ink ribbon 6 is bridged indirectly between the winding shaft 8 and the unwinding shaft 9, so that the ink ribbon 6 is arranged in the ribbon cassette 30.

The ribbon cassette 30 comprises a cassette case 31 formed with an upper opening portion 34 at an opening portion and a lower opening portion 34A at a lower opening portion thereof, and a winding roll 32 and an unwinding roll 33 disposed rotatably inside the cassette case 31.

The ink ribbon 6 is hung with the winding roll 32 in a state where it is wound with the unwinding roll 33. These rolls 32, 33 are engaged with cups 8*a*, 9*a* formed on leading ends of the winding shaft 8 and the unwinding shaft 9 when the ribbon cassette 30 is set in the apparatus main body 1. Thereby, the winding roll 32 is rotated integrally with the winding shaft 8, and the unwinding roll 33 is rotated integrally with the unwinding shaft 9.

Figure 4:
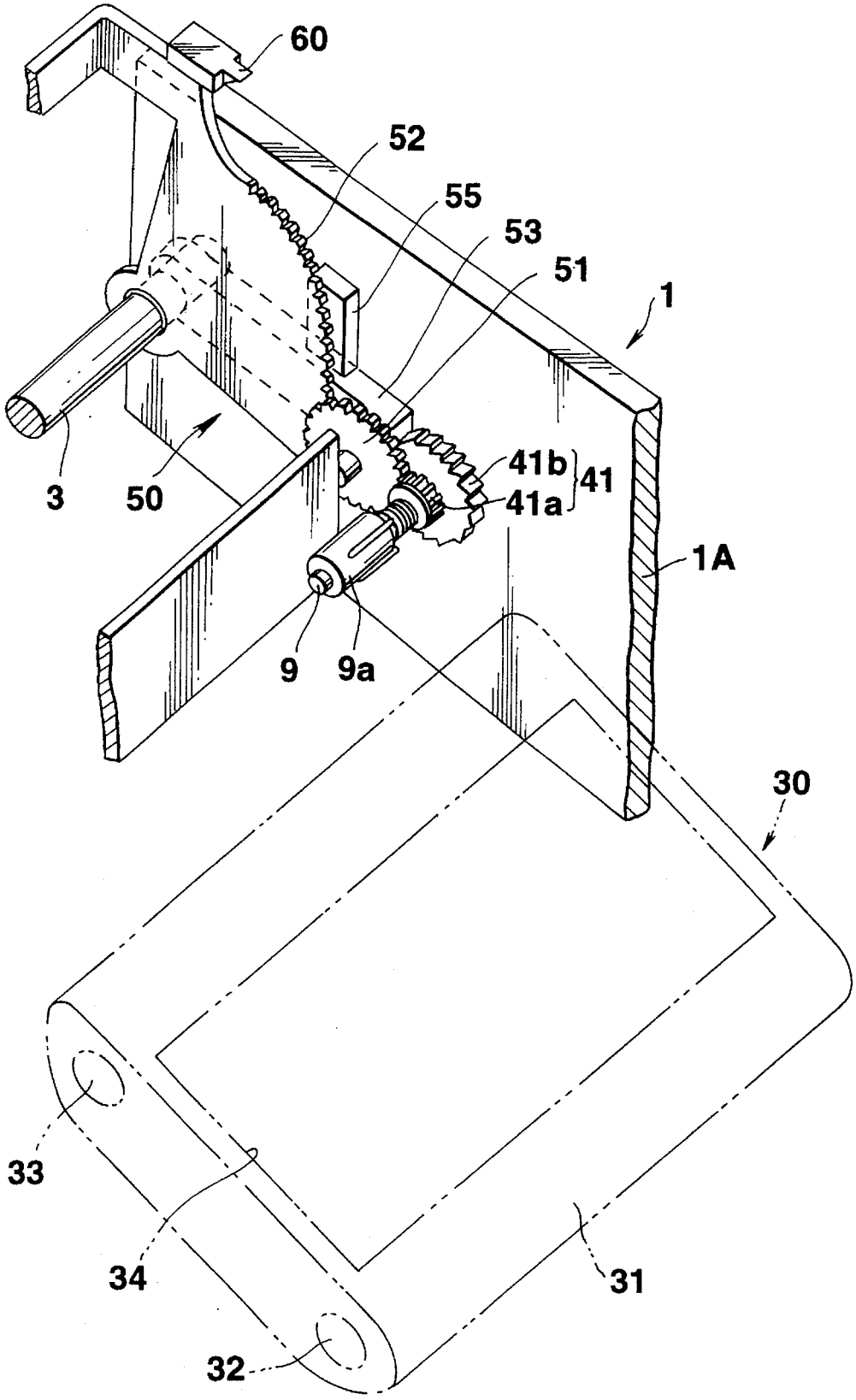
FIG. 4 is a perspective view of a main part around an unwinding shaft.

In FIGS. 3 and 4, since the upper opening portion 34 mentioned above is formed on an upper center portion of the cassette case 31, the printing head 4 disposed on a lower portion of the head attaching member 7 is adapted to enter into the ribbon cassette 30 through the upper opening portion 34 when the head arm 10 and the head attaching member 7 are operated to descend, and to the contrary, the printing head 4 entering into the ribbon cassette 30 through the upper opening portion 34 is adapted to retreat to an outside of the ribbon cassette 30 when the head arm 10 and the head attaching member 7 are operated to ascend.

This embodiment is constructed such that the unwinding shaft 9 is automatically rotated in the winding direction of the ink ribbon 6 in association with an upward rotation of the head attaching member 7 when the head attaching member 7 is rotated upward. Also, this embodiment is constructed such that, when the ink ribbon 6 runs in the winding direction with the rotation of the winding shaft 8 in the winding direction, the ink ribbon 6 during running is applied with a back tension.

This construction will be described hereinafter with reference to FIGS. 4 to 7.

Figure 5:
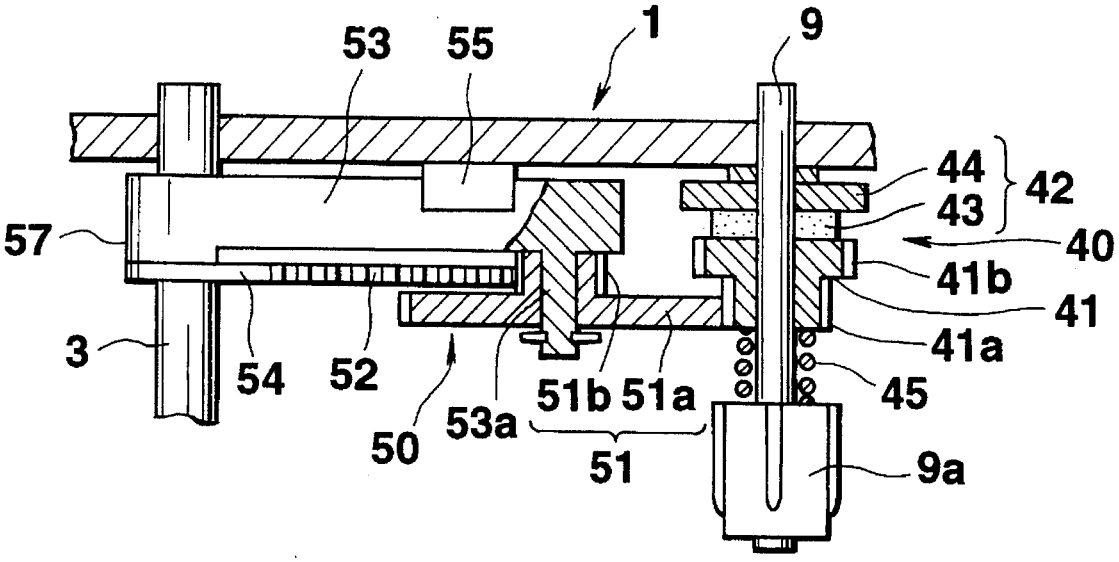
FIG. 5 is a sectional view of a main part around an unwinding shaft.

First, the unwinding shaft 9 is attached with a transmitting member 40 for transmitting a torque in such a direction as to unwind the ink ribbon 6. As shown in FIG. 5, the transmitting member 40 comprises a transmitting gear 41 attached rotatably to the unwinding shaft 9, and a clutch member 42 having a through hole through which the unwinding shaft 9 passes.

The clutch member 42 is constituted by a friction plate 43 plane-contacted to the transmitting gear 41, and a clutch plate 44 interposing the friction plate 43 in association with the transmitting gear 41.

The friction plate 43 is made of a material which is great in friction coefficient, such as a felt, a rubber and the like. The friction plate 43 is adapted to contact to the transmitting gear 41 with a friction force by plane-contacting to the transmitting gear 41. Also, as described later, the friction plate 43 is adapted to apply a back tension to the unwinding shaft 9 so as to apply a back tension to the ink ribbon 6 due to the friction force, when the ink ribbon 6 runs in the winding direction.

A spring 45 disposed between the cup 9*a* of the unwinding shaft 9 and the transmitting gear 41 aims to urge the transmitting gear 41, the friction plate 43 and the clutch plate 44 so as to cause them to friction-contact among each other.

Figure 6:
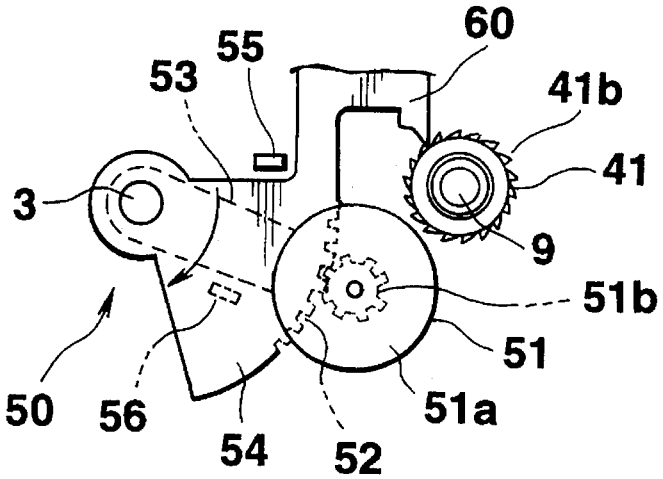
FIG. 6 is a side view of a main part around an unwinding shaft in a case where a cover member is closed.
Figure 7:
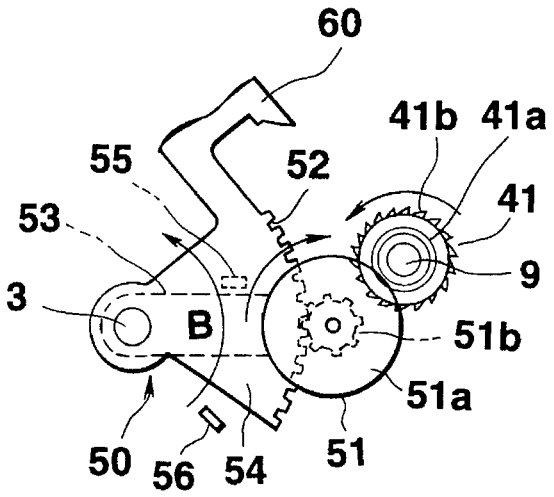
FIG. 7 is a side view of a main part around an unwinding shaft in a case where a cover member is opened.

The transmitting gear 41 aims to rotate the unwinding shaft 9 in the unwinding direction of the ink ribbon 6 through the friction plate 43, and the transmitting gear 41 comprises a small diameter gear 41*a* and a large diameter gear 41*b*. The large diameter gear 41*b* has ratchet teeth as shown in FIGS. 4, 6 and 7. Thereby, the transmitting gear 41 is adapted to rotate only in one direction in which the ink ribbon 6 is unwound.

An unwinding mechanism 50 is adapted to mesh engagably and disengagably with the small diameter gear 41*a* of the transmitting gear 41.

The unwinding mechanism 50 comprises a first unwinding gear 51 and a second unwinding gear 52 as shown in FIGS. 4 to 7. The gears 51, 52 are attached to the supporting shaft 3 of the apparatus main body 1 so as to rotate integrally with the support shaft 3.

The first unwinding gear 51 is fitted to a rotating arm 53 attached to the supporting shaft 3. The first unwinding gear 51 comprises a large diameter gear 1*a* and a small diameter gear 51b. The large diameter gear 51*a* is adapted to mesh engagably and disengagably with the small diameter gear 41*a* of the transmitting gear 41 (Refer to FIGS. 6 and 7).

On the other hand, the second unwinding gear 52 is formed by conducting a gear cutting to an end face of a leading end of a fan-shaped rotating arm 54 attached to the supporting shaft 3. The second unwinding gear 52 is always meshed with the small diameter gear 51*b* of the first unwinding gear 51 to thereby transmit a torque to the first unwinding gear 51.

The second unwinding gear 52 and the first unwinding gear 51 are rotated integrally to each other with the rotation of the head attaching member 7, however the second unwinding gear 52 is set to be greater in rotating range than the first unwinding gear 51. Accordingly, an upper limit stopper 55 and a lower limit stopper 56 are arranged at a predetermined position on the rotating region of the rotating arm 53 fitted with the first unwinding gear 51 so as to be spaced apart from each other by a predetermined distance. The rotating range of the first unwinding gear 51 is limited by the upper limit stopper 55 and the lower limit stopper 56.

The first unwinding gear 51 is fitted to the rotating arm 53 by protruding from a shaft portion 53*a* integrally from the rotating arm 53 and attaching the first unwinding gear 51 to the shaft portion 53*a*, as shown in FIG. 5.

At the time of attaching them, if a viscosity substance such as a grease, an oil damper and the like (not shown) is poured between the shaft portion 53*a* and the first unwinding gear 51 and the substance exists between the shaft portion 53*a* and the first unwinding gear 51, the rotation of the first unwinding gear 51 is controlled to some extent due to a function of the substance. Therefore, when the rotating arm 53 and the rotating plate 54 are rotated integrally with each other, the first unwinding gear 51 cannot be rotated on its own axis. On the other hand, when the rotating arm 53 stops to rotate and only the rotating plate 54 rotates, the first unwinding gear 51 can be rotated around the second unwinding gear 52. Moreover, aside from this, there is provided a plane-contacting portion 57 at which the rotating arm 53 and the rotating plate 54 (Refer to FIG. 5) are plane-contacted to each other, and the above mentioned functions in which the rotation of the first unwinding gear 51 on its own axis is controlled is performed due to the mutual friction contacting by the plane-contacting portion 57.

An engaging member 60 protruding at a lead thereof so as to correspond to the transmitting gear 41 is formed on an upper portion of the fan-shaped rotating plate 54 as shown in FIGS. 4, 6 and 7. The engaging member 60 is adapted to engage and disengage with the large diameter gear 41*b* of the transmitting gear 41 comprising the ratchet teeth. When the engaging member 60 is engaged with the large diameter gear 41*b*, the transmitting gear 41 is adapted to be locked in rotation in the winding direction of the ink ribbon. When the transmitting gear 41 is locked, the unwinding shaft 9 is adapted to be applied with a back tension against the rotation in the winding direction of the ink ribbon 6.

Next, a function of this embodiment will be explained.

Figure 8:
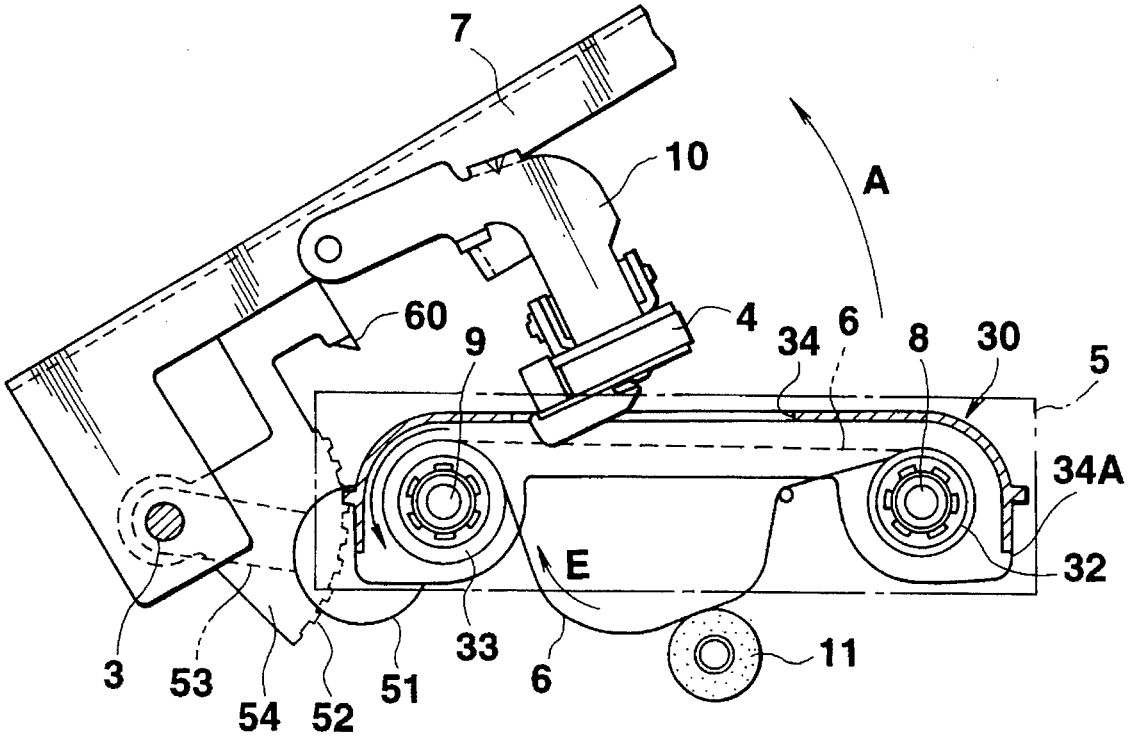
FIG. 8 is a side view of a main part around a winding shaft and an unwinding shaft in a case where a cover member is opened.

The cover member 2 is rotated to be opened (Refer to FIG. 1) from the printing state shown in FIG. 3, so that the arm attaching member 7 is rotated in an arrow direction A as shown in FIG. 8 in connection with the rotation of the cover member 2. Thereby, the printing head 4 retreats from the inside of the ribbon cassette 30 through the upper opening portion 34.

When the supporting shaft 3 is rotated due to the rotation of the arm attaching member 7, the arm 53 and the rotating plate 54 are rotated integrally upward in an arrow direction B as shown in FIG. 7. Incidentally, during such the rotation, the first unwinding gear 51 cannot be rotated about its own axis as described above.

When the large diameter gear 51*a* formed on the unwinding gear 51 is meshed with the small diameter gear 41*a* of the transmitting gear 41 according to the upward rotation of the rotating plate 54, the rotating arm 53 stops rotating to the upper limit stopper 5 simultaneously to the upper stopper 55 to be stopped in rotation.

On the contrary, since the rotating plate 54 continues to rotate, the second unwinding gear 52 meshing with the small diameter gear 51*b* rotates the first unwinding gear 51. Thereby, the first unwinding gear 51 rotates the transmitting gear 41 in the unwinding direction of ink ribbon 6. Since such the transmitting gear 41 is friction-contacted with the friction plate 43 of the clutch member 42, there is a torque in the unwinding direction of the transmitting gear 41, so that the unwinding shaft 9 is rotated in the unwinding direction and the ink ribbon 6 is unwound toward the unwinding roll 33 (an arrow direction E in FIG. 8). Thereby, the ink ribbon 6 is drawn into the cassette 30, so that a dip portion of the ink ribbon 6 is eliminated. As a result, the ink ribbon 6 is held linearly between the unwinding shaft 9 and the winding shaft 8 as shown by a dotted line in FIG. 8.

Since, the ink ribbon 6 is held linearly between the unwinding shaft 9 and the winding shaft 8 in the cassette 30 in the above mentioned state, when the ribbon cassette 30 is taken out from the inlet and the outlet opening 5 toward an outside of the apparatus main body 1, the dip portion of the ink ribbon 6 can be taken out smoothly without interfering with various parts disposed in the apparatus main body 1 and a lower edge 5*a* of the inlet and outlet opening 5.

In this embodiment, in this way, when the arm attaching member 7 is rotated to be opened, the unwinding shaft 9 is rotated automatically in the unwinding direction of the ink ribbon 6 in connection with the rotation of the arm attaching member 7, so that the dip of the ink ribbon 6 is eliminated. Accordingly, there is no need to rotate the unwinding shaft 9 by the motor as before. Therefore, even when the motor gets out of order or the electric power is off, the ink ribbon 6 can be drawn into the cassette 30 so as to eliminate the dip. The ribbon cassette 30 can be taken out of the inlet and outlet opening 5 smoothly and rapidly.

Incidentally, gear ratios of the first and second unwinding gears 51, 52 and the transmitting gear 41 are set in such a manner that the unwinding shaft 9 rotates in the unwinding direction of the ink ribbon 6 more than the dip of the ink ribbon 6 is eliminated.

On the other hand, when the cover member 2 is closed in a state in which the ribbon cassette 30 is set on the apparatus main body 1, as shown in FIG. 3, the printing head 4 is entered into the ribbon cassette 30 through the upper opening portion 34 to thereby press-contact to the platen 11 through the ink ribbon 6 and the recording paper 12. Accordingly, the printing state to the recording paper can be realized.

FIG. 6 shows a state in which the cover member 2 is closed.

As shown in FIG. 6, the cover member 2 is closed and the first and second unwinding gears 51, 52 are rotated downward, the first unwinding gear 51 is disengaged with the transmitting gear 41, after that, the rotating arm 53 is abutted to the lower limit stopper 56. As a result, the rotating arm 53 is stopped without rotating more. Simultaneously, the engaging member 60 is engaged with the large diameter gear 41*b* of the transmitting gear 41, thereby the rotating plate 54 is stopped.

In this state, when the winding shaft 8 is rotated in the winding direction of the ink ribbon 6 by the winding motor M, the transmitting gear 41 is prevented from rotating in the same direction because it engages with the engaging member 60. In this case, the friction plate 43 contacts to the transmitting gear 41 in a friction-engaging state, so that the friction plate 43 does not rotate also.

In such a state, the unwinding shaft 9 is applied with a back tension to the rotation of the ink ribbon in the winding direction.

On the other hand, when the unwinding shaft 9 is applied with a torque greater than the friction force of the friction plate 43, simultaneously the unwinding shaft 9 starts to rotate in the winding direction. Accordingly, since the winding of the ink ribbon is carried out by applying a predetermined torque to the unwinding shaft 9, the ink ribbon runs in a tensioned state. Thereby, the ink ribbon is prevented from jamming surely.

In the above mentioned embodiments, the present invention is applied to the printer, however, the present invention can be applied to the audio equipment and video apparatus. In case of the audio equipment, a magnetic tape is used instead of the ink ribbon 6, and a recording head is used as the head member instead of the printing head 4. Moreover, in case of the video apparatus, a video tape is used as the sheet member, and a video head is used as the head member. In these equipments and apparatus, the sheet member is unwound automatically by making the construction thereof in such a manner that the unwinding shaft is mechanically rotated in connection with the rotation of the head attaching member similarly to the above mentioned embodiment, and also, the jamming on the running of the sheet member is prevented by making the construction thereof in such a manner that the unwinding shaft is applied with a back tension.

According to the present invention, when the head attaching member is rotated in such a manner that the head member separates from the sheet member, since the unwinding member rotates the unwinding shaft in the cassette in the unwinding direction of the head member to thereby unwind the sheet member in connection with the rotation of the head attaching member, the sheet member can be unwound mechanically without driving the unwinding shaft by the motor, in connection with the separation of the head member.

Also, according to the present invention, since the winding shaft is adapted to apply a back tension to the sheet member in a direction opposite to the winding direction when the winding shaft winds the sheet member, the unwinding shaft is rotated abruptly and the sheet member is run stably in a predetermined pre-tension state, in a case where the winding torque is not greater than a predetermined value even if the torque in the winding direction of the sheet member is applied to the unwinding shaft abruptly, so that the sheet member can be prevented from the jamming previously.

What is claimed is:

1. An unwinding apparatus for use with a cassette including upper and lower opening portions at upper and lower portions thereof and a tape-like sheet member therein, said unwinding apparatus comprising:

an apparatus main body having a cassette inlet and outlet opening at a side portion thereof such that the cassette 13 detachable with the apparatus main body through the cassette inlet and outlet opening of the apparatus main body, the apparatus main body including a winding shaft and an unwinding shaft such that the tape-like sheet member is bridged between the winding shaft and the unwinding shaft when inserted in the apparatus main body;

a head member inserted into the cassette through the upper opening portion formed on the cassette for pressing down the sheet member to position below the lower opening portion;

a head attaching member attached with the head member and movably disposed on the apparatus main body in an upward and downward direction so as to bring the head member into contact with the sheet member and to separate the head member from the sheet member;

an abutting member disposed on the apparatus main body at a position opposed to the head member so as to abut the head member through the sheet member; and unwinding means for rotating the unwinding shaft to move the sheet member in an unwinding direction in connection with the movement of the head attaching member when the head attaching member moves in a direction to separate the head member from the sheet member, so as to move the sheet member in a tensioning direction.

2. An unwinding apparatus according to claim 1, further comprising;

a cover member; and a supporting shaft rotatably mounting said cover member to the apparatus main body, with the supporting shaft as a rotating center, and wherein the head attaching member is disposed on a lower face of the cover member.

3. An unwinding apparatus according to claim 1, further comprising:

winding and driving means for rotating the winding shaft in winding direction; and back tension applying means for applying a back tension to a winding movement of the sheet member with the rotation of the winding shaft in the winding direction by the winding and driving means when the head member attaching member moves in a direction to bring the head member into contact with the sheet member.

4. An unwinding apparatus for use with a cassette including upper and lower opening portions at upper and lower portions thereof and a tape-like sheet member therein, said unwinding apparatus comprising:

an apparatus main body having a cassette inlet and outlet opening at a side portion thereof such that the cassette is detachable with the apparatus main body through the cassette inlet and outlet opening of the apparatus main body, the apparatus main body including a winding shaft and an unwinding shaft such that the tape-like sheet member is bridged between the winding shaft and the unwinding shaft when inserted in the apparatus main body;

a head member inserted into the cassette through the upper opening portion formed on the cassette for pressing down the sheet member to a position below the lower opening portion;

a head attaching member attached with the head member and movably disposed on the apparatus main body in an upward and downward direction so as to bring the head member into contact with the sheet member and to separate the head member from the sheet member;

an abutting member disposed on the apparatus main body at a position opposed to the head member so as to abut the head member through the sheet member;

unwinding means for rotating the unwinding shaft to move the sheet member in an unwinding direction in connection with the movement of the head attaching member when the head attaching member moves in a direction to separate the head member from the sheet member;

winding and driving means for rotating the winding shaft in the winding direction; and back tension applying means for applying a back tension to a winding movement of the sheet member with the rotation of the winding shaft in the winding direction by the winding and driving means when the head member attaching member moves in a direction to bring the head member into contact with the sheet member, the back tension applying means comprising:

a gear rotatably attached to the unwinding shaft;

engaging means for engaging with the gear when the head attaching member moves in a direction to bring the head member into contact with the sheet member;

a clutch member for friction-contacting with a predetermined friction force to the gear to restrict the rotation of the unwinding shaft; and an elastic member for pressing the gear and the clutch member in such a manner that the gear and the clutch member are friction-contacted to each other.

5. An unwinding apparatus according to claim 1, wherein the head member comprises a printing head for contacting the sheet member to print.

6. An unwinding apparatus for use with a cassette including upper and lower opening portions at upper and lower portions thereof and a tape-like sheet member therein, said unwinding apparatus comprising:

an apparatus main body having a cassette inlet and outlet opening at a side portion thereof such that the cassette is detachable with the apparatus main body through the cassette inlet and outlet opening of the apparatus main body, the apparatus main body including a winding shaft and an unwinding shaft such that the tape-like sheet member is bridged between the winding shaft and the unwinding shaft when inserted in the apparatus main body;

a cover member;

a supporting shaft rotatably mounting said cover member on the apparatus main body, with the supporting shaft as a rotation center;

a head attaching member disposed on a lower face of the cover member;

a head member inserted into the cassette through the upper opening portion formed on the cassette when the cover member is closed, the head member disposed on the head attaching member for pressing down the sheet member to a position below the lower opening portion;

winding and driving means for rotating the winding shaft in the winding direction; and unwinding means for rotating the unwinding shaft to move the sheet member in an unwinding direction in connection with movement of the cover member when the cover member rotates in a direction to separate the head member from the sheet member, so as to move the sheet member in a tensioning direction.

7. An unwinding apparatus according to claim 6, wherein the unwinding means further comprises:

rotating means for rotating the unwinding shaft in connection with the rotation of the cover member when the cover member rotates in a direction to separate the head member from the sheet member; and a gear disposed on the unwinding shaft for rotating the unwinding shaft in the unwinding direction of the sheet member according to the rotation of the rotating means.

8. An unwinding apparatus according to claim 6, further comprising:

back tension applying means for applying a back tension to a winding movement of the sheet member with the rotation of the winding shaft in the winding direction by the winding and driving means when the head member attaching member moves in a direction to bring the head member in contact with the sheet member.

9. An unwinding apparatus for use with a cassette including upper and lower opening portions at upper and lower portions thereof and a tape-like sheet member therein, said unwinding apparatus comprising:

an apparatus main body having a cassette inlet and outlet opening at a side portion thereof such that the cassette is detachable with the apparatus main body through the cassette inlet and outlet opening of the apparatus main body, the apparatus main body including a winding shaft and an unwinding shaft such that the tape-like sheet member is bridged between the winding shaft and the unwinding shaft when inserted in the apparatus main body;

a cover member;

a supporting shaft rotatably mounting said cover member on the apparatus main body, with the supporting shaft as a rotation center;

a head attaching member disposed on a lower face of the cover member;

a head member inserted into the cassette through the upper opening portion formed on the cassette when the cover member is closed, the head member disposed on the head attaching member for pressing down the sheet member to a position below the lower opening portion;

winding and driving means for rotating the winding shaft in the winding direction;

unwinding means for rotating the unwinding shaft to move the sheet member in an unwinding direction in connection with movement of the cover member when the cover member rotates in a direction to separate the head member from the sheet member, so as to move the sheet member in a tensioning direction; and back tension applying means for applying a back tension to a winding movement of the sheet member with the rotation of the winding shaft in the winding direction by the winding and driving means when the head member attaching member moves in a direction to bring the head member in contact with the sheet member, the back tension applying means comprising:

a gear rotatably attached to the unwinding shaft;

engaging means for engaging with the gear when the head attaching member moves in a direction to bring the head member in contact with the sheet member;

a clutch member for friction-contacting with a predetermined friction force to the gear to restrict the rotation of the unwinding shaft; and an elastic member for pressing the gear and the clutch member in such a manner that the gear and the clutch member are friction-contacted to each other.

10. An unwinding apparatus according to claim 6, wherein the head member comprises a printing head for contacting the sheet member to print.

11. An unwinding apparatus comprising:

a winding shaft;

an unwinding shaft;

a head member contacting a tape-like sheet member bridged between the winding shaft and the unwinding shaft;

a head attaching member attached with the head member for rotating the head member so as to bring the head member into contact with the sheet member and to separate the head member the sheet member;

a transmitting member for transmitting a torque of the sheet member in an unwinding direction to the unwinding shaft; and unwinding means engaging with the transmitting member in connection with the rotation of the head attaching member in a direction to separate the head member from the sheet member.

12. An winding apparatus according to claim 11, further comprising:

an apparatus main body including said winding shaft and unwinding shaft, a cover member, a supporting shaft rotatably mounting said cover member to the apparatus main body, with the supporting shaft as a rotating center, and wherein the head attaching member is disposed on a lower face of the cover member.

13. An unwinding apparatus according to claim 11, further comprising:

winding and driving means for rotating the winding shaft in a winding direction; and back tension applying means for applying a back tension to a winding movement of the sheet member with the rotation of the winding shaft in the winding direction by the winding and driving means when the head member attaching member moves in a direction to bring the head member in contact with the sheet member.

14. An unwinding apparatus comprising:

a winding shaft;

an unwinding shaft;

a head member contacting a tape-like sheet member bridged between the winding shaft and the unwinding shaft;

a head attaching member attached with the head member for rotating the head member so as to bring the head member into contact with the sheet member and to separate the head member from the sheet member;

a transmitting member for transmitting a torque of the sheet member in an unwinding direction to the unwinding shaft;

unwinding means engaging with the transmitting member in connection with the rotation of the head attaching member in a direction to separate the head member from the sheet member;

winding and driving means for rotating the winding shaft in a winding direction; and back tension applying means for applying a back tension to a winding movement of the sheet member with the rotation of the winding shaft in the winding direction by the winding and driving means when the head member attaching member moves in a direction to bring the head member in contact with the sheet member, the back tension applying means comprising:

a gear rotatably attached to the unwinding shaft;

engaging means for engaging with the gear when the head attaching member moves in a direction to bring the head member in contact with the sheet member;

a clutch member for friction-contacting with a predetermined friction force to the gear to restrict the rotation of the unwinding shaft; and an elastic member for pressing the gear and the clutch member in such a manner that the gear and the clutch member are friction-contacted to each other.

15. An unwinding apparatus according to claim 11, wherein the head member comprises a printing head for contacting the sheet member to print.

* * * * *

UNITED STATES PATENT AND TRADEMARK OFFICE

CERTIFICATE OF CORRECTION

PATENT NO. : 5,588,755

DATED : December 31, 1996

INVENTOR(S) : NIMURA, Wataru

It is certified that error appears in the above-indentified patent and that said Letters Patent is hereby corrected as shown below:

Column 8, line 35 (claim 1), "13" should be --is-- line 44 (claim 1), before "position" insert --a--

Signed and Sealed this

Fifteenth Day of July, 1997

Bruce Lehman

*Attest:*

BRUCE LEHMAN

*Attesting Officer*

*Commissioner of Patents and Trademarks*